United States Patent [19]

Gordon et al.

[11] Patent Number: 4,982,653

[45] Date of Patent: Jan. 8, 1991

[54] METHOD AND APPARATUS FOR VENTILATING AN ENCLOSURE ACCESSED BY A MANHOLE

[75] Inventors: Russell B. Gordon; Jimmy A. Gordon, both of Atlantic Beach, Fla.; Marion W. Smith, Daphne, Ala.

[73] Assignee: Saddle Vent, Inc., Atlantic Beach, Fla.

[21] Appl. No.: 292,428

[22] Filed: Dec. 30, 1988

Related U.S. Application Data

[63] Continuation-in-part of Ser. No. 71,886, Jui. 10, 1987, Pat. No. 4,794,956.

[51] Int. Cl.[5] ..... F24F 7/06

[52] U.S. Cl. ..... 98/39.1; 98/33.1; 98/40.19; 138/39; 138/106

[58] Field of Search ..... 52/20; 98/1, 29, 33.1, 98/37, 39.1, 40.19, 49, 50, 87, DIG. 7; 138/39, 103, 106, 107, 108, 109, 111, 115, 116, 122, 178; 248/49, 56, 58, 60, 66; 285/179

[56] References Cited

U.S. PATENT DOCUMENTS

| | | | |
|---|---|---|---|
| 396,773 | 1/1889 | Smith | 285/179 X |
| 1,191,621 | 7/1916 | Schmidt | 285/179 X |
| 1,782,779 | 11/1930 | Fullman | 285/179 X |
| 1,900,642 | 3/1933 | Gerlack | 98/1 X |
| 2,056,782 | 10/1936 | Fosdick | 138/39 |
| 2,364,144 | 12/1944 | Hunsaker | 98/32 |
| 2,420,123 | 5/1947 | Cooper | 98/39.1 |
| 3,093,056 | 7/1963 | Rosenfeld | 98/35 |
| 3,359,883 | 12/1967 | Murphy | 98/40.19 |
| 3,610,524 | 10/1971 | Wallen | 98/33.1 |
| 3,757,664 | 9/1973 | Jalbert | 98/37 |
| 3,894,302 | 7/1975 | Lasater | 138/39 X |
| 4,023,833 | 5/1977 | Wellard | 285/179 |
| 4,285,269 | 8/1981 | Pelsve et al. | 98/33.1 |
| 4,463,779 | 8/1984 | Wink et al. | 138/133 X |

FOREIGN PATENT DOCUMENTS

| | | | |
|---|---|---|---|
| 966378 | 8/1957 | Fed. Rep. of Germany | 98/39.1 |
| 259758 | 8/1928 | Italy | 138/39 |
| 575382 | 4/1958 | Italy | 98/39.1 |

*Primary Examiner*—Harold Joyce
*Attorney, Agent, or Firm*—Nixon & Vanderhye

[57] ABSTRACT

An air ventilation conduit and related process are provided for ventilating an enclosure accessed by a manhole. In one embodiment, the conduit has a pair of outer cylindrical sections and a central section having a cross-sectional shape of a crescent or a segment of a circle where it passes through the manhole to provide a minimum of obstruction for men and equipment passing through the manhole. Intermediate sections of varying cross-section connect the central section to the cylindrical outer sections so that the outer sections are offset from the axis of the manhole. The central section is configured to obstruct no more than about 10 percent of the manhole opening, while causing either no air flow rate reduction, or a reduction of no more than about 10 percent as compared to the flow rate through a cylindrical conduit similar to said outer sections.

26 Claims, 9 Drawing Sheets

METHOD AND APPARATUS FOR VENTILATING AN ENCLOSURE ACCESSED BY A MANHOLE

RELATED APPLICATIONS

This is a continuation-in-part of application Ser. No. 07/071,886, filed July 10, 1987, now U.S. Pat. No. 4,794,956.

BACKGROUND AND SUMMARY OF THE INVENTION

Tanks, sewers, and other enclosures that must be entered periodically require some type of air ventilation system for the men working in the enclosure. Without some type of air ventilation the workers would be required to wear respirators. The current apparatus used today normally includes an air pump outside the enclosure and an 8-inch flexible hose leading into the enclosure. However, the normal 24 inch (or smaller) manhole is barely large enough to allow a worker to enter the enclosure with tools and/or materials. When an 8-inch ventilating hose is also located within the manhole, it may prevent the worker from entering the enclosure, and it always provides an obstruction that tends to catch tools on the worker's belt, with the possibility of damaging the hose or dropping tools on another worker already in the enclosure.

This invention relates to a method and apparatus for passing air into an enclosure through a manhole with a minimum of obstruction at the manhole. In one exemplary embodiment, the conduit comprises a central section having a cross section in the shape of a crescent or a segment of a circle, two intermediate sections attached respectively to each end of the central section, and each having a cross-sectional shape varying from the shape of the central section at the juncture with said central section, and tapering to a circular shape at the outer end of the associated intermediate section. The conduit also includes two outer cylindrical sections, respectively attached to the outer end of each of the intermediate sections, the outer sections being externally aligned on a common axis.

As a result of this construction, it is possible to reduce the cross-sectional obstruction of a relatively small manhole, i.e., with about a 20 inch diameter, to about 10 percent of the cross-sectional area of the manhole, as compared to about 35 percent obstruction for a standard 8 inch diameter hose. For larger manholes, the percent obstruction using the conduit of this invention may be substantially less than 10 percent.

In this exemplary embodiment of the invention, an outer surface of the central section is cylindrical and has substantially the same diameter as the diameter of the manhole in which the conduit is used. In the interest of economy, however, it is practical to utilize a standard size conduit which will fit virtually all conventional manholes. For example, a central section having a radius of curvature conforming to a smaller manhole radius, may be effectively utilized in all larger manholes as well.

It is also a feature of this invention that the cross-sectional area of the central section may be reduced in comparison to the outer cylindrical sections, but only to the extent of causing a reduction of not more than about 10 percent in air flow rate, as explained below.

It is also a feature of this invention that means are provided at the outer surface of the central section of the conduit so that the conduit may be hung or otherwise attached at the manhole opening.

A related process in accordance with the invention, in its broadest aspects, includes the steps of providing a ventilation conduit as described above, locating the conduit so that one outer end and an associated intermediate section lie outside the enclosure, the other outer end and its associated intermediate section lie inside the enclosure, and the central section extends through the manhole; and operatively connecting the conduit to an external source of air, such as a pump.

It is therefore an object of this invention to provide an improved air conduit and related process for ventilating an enclosure with a manhole entrance. It is another object of this invention to provide such an air conduit which is somewhat "flattened" in the area where it passes through the manhole so as to obstruct not more than about ten percent of the cross-sectional area of the manhole, without any significant reduction in air flow through all sections of the conduit. Still other objects will appear in the more detailed description which follows.

BRIEF DESCRIPTION OF THE DRAWINGS

The novel features which are believed to be characteristic of this invention are set forth with particularity in the appended claims. The invention itself, however, both as its organization and method of operation, together with further objects and advantages thereof, may best be understood by reference to the following description taken in connection with the accompanying drawings in which:

DETAILED DESCRIPTION OF THE DRAWINGS

The structural details of the conduit of this invention are best understood by reference to the attached drawings.

In exemplary embodiments, the conduit is comprised of five sections connected end to end. There is a central section 20 connected at each end to an intermediate section 21, which in turn are connected to two outer or end sections 22. Preferably, the conduit is made of thin, light weight material such as sheet metal, transparent plastic, or the like.

Figure 4:
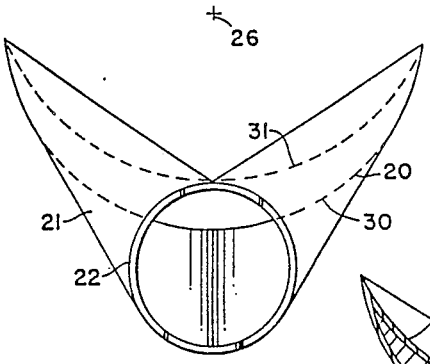
FIG. 4 is an end elevational view looking in the direction of 4—4 of FIG. 2.
Figure 5:
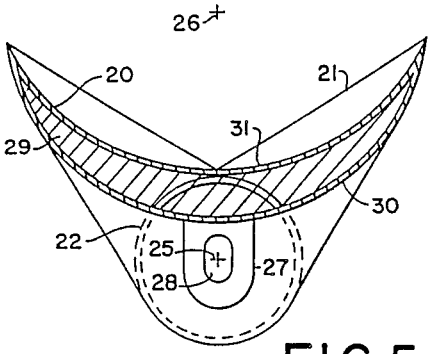
FIG. 5 is a cross-sectional view taken at 5—5 of FIG. 2.
Figure 6:
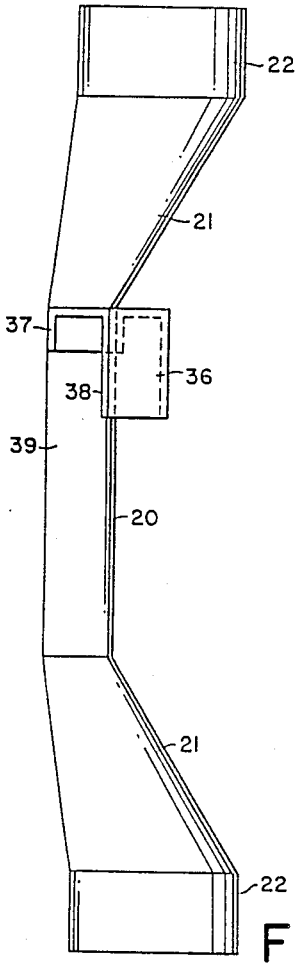
FIG. 6 is a front elevational view of a second embodiment of the conduit of this invention.
Figure 7:
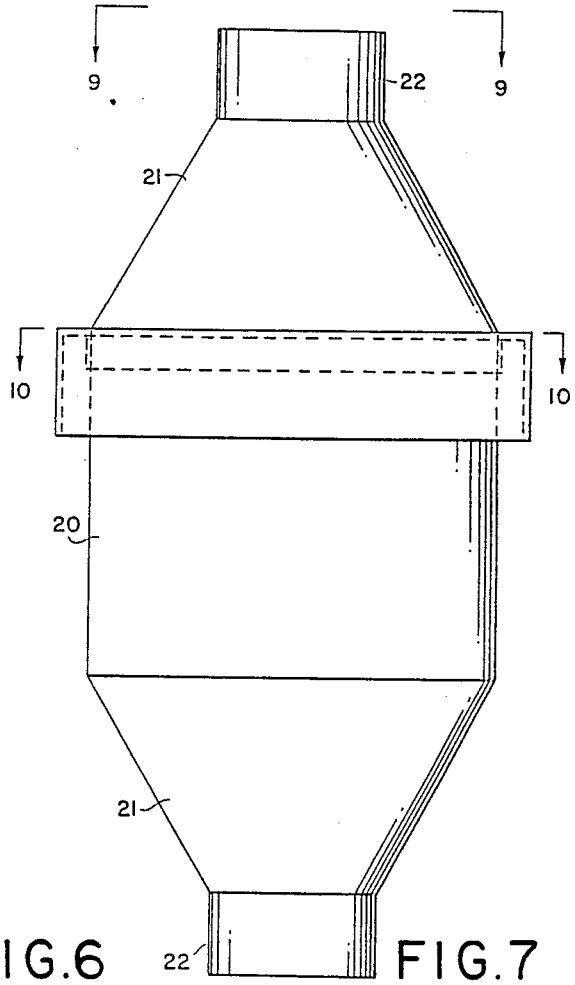
FIG. 7 is a top plan view of the conduit of FIG. 6.
Figure 8:
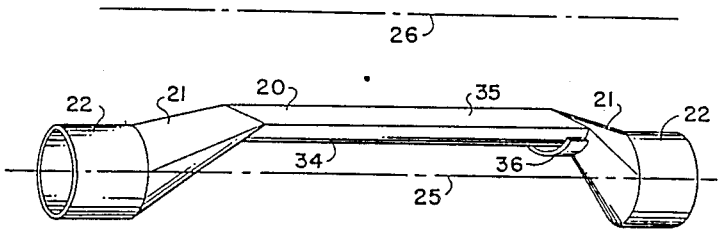
FIG. 8 is a perspective view of the conduit of FIG. 6.
Figure 9:
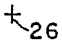
FIG. 9 is an end elevational view looking in the direction of 9—9 of FIG. 7.
Figure 9:
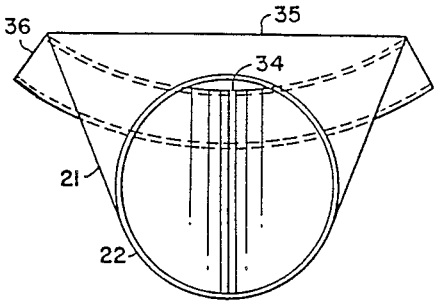
Figure 10:
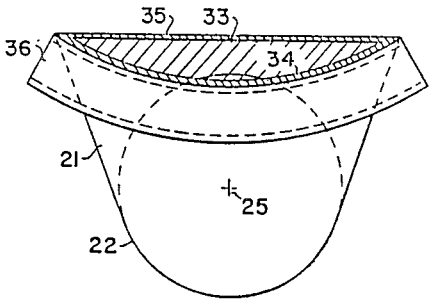
FIG. 10 is a cross-sectional view taken at 10—10 of FIG. 7.

Central section 20 has a non-cylindrical shape, i.e., a non-circular cross-section the a crescent a segment of a circle. An outer surface 30 of the central section 20 is cylindrical when the cross-section is crescent shaped, and in the form of a flat plane when the cross-section is a segment of a circle. FIGS. 1–5 show a crescent shaped cross-section and FIGS. 6–13 show a cross-section which has the shape of a segment of a circle. With reference to FIG. 5, it will be noted that the radius of outer surface 30 is less than the radius of the inner surface 31, to thereby create the crescent shape. Inner surface 31 is not limited to being a flat plane or being cylindrical, e.g., it can be two or more intersecting planes, an irregular curved surface, or the like. In one exemplary embodiment, outer surface 30 fits snugly into the manhole opening. In other words, the radius of curvature of outer surface 30 is substantially the same as the radius of the manhole opening. This, of course, requires the production of different conduits for different diameter manholes. It is more economical to produce a single conduit configuration for virtually all manholes, and the fact that the outer surface of the center conduit section does not fit flush with the peripheral surface of the manhole is not significant.

Thus, a central section having a radius of curvature corresponding to the smallest of the commonly used manhole structures, may also be utilized with all larger manhole openings.

Throughout the length of central section 20, the shape of the cross-section preferably remains the same, although this shape may be variable. The central axis 26 of central section 20 is the center of the circle represented by outer surface 30.

Transition or intermediate sections 21 join central sections 20 at juncture lines 23 at one end and join outer sections 22 at juncture lines 24 at the other end. At juncture line 23 the cross-section of intermediate section 21 is the same shape as that of central section 20, and at juncture line 24 is a circle. In between juncture lines 23 and 24 the cross-sectional shape changes at every position tapering along longitudinal axis 32 from a crescent or segment to a circle. The unusual wing-shaped structure or butterfly-shaped structure of intermediate sections 21 is shown in FIGS. 4 and 5 where the cross-sectional shape of central section 20 is a crescent.

Outer sections 22 are cylindrical, preferably about 8 inches in diameter so as to fit already existing ventilating equipment. Other diameters are, of course, within the scope of this invention. Both outer sections 22 are preferably aligned on a common longitudinal axis 25 parallel to axis 26 of central section 20, although this is not a critical feature. Outer sections 22 need not be aligned on a common axis, and if aligned, their axes need not be parallel to axis 26. Each outer section 22 is attachable to flexible hose leading to a pump P at one end, and to any position in the enclosure at the other end, as desired by the person(s) working therein. Typically, pumps utilized for ventilating manholes comprise air blowers rated at 500CFM, and typically generate a flow rate of about 700–800 CFM.

Another feature of this invention is that the cross-sectional shapes of the conduit at any location from one end to the other are such that the cross-sectional areas may be substantially constant, so that the air being pumped through the conduit has no obstruction and will flow smoothly. Thus the area of crescent cross section 29 (FIG. 5), shown crosshatched, is substantially the same as the area of the circle at 22.

It has now been discovered, however, that the cross-sectional area of the center section of the conduit may be less than the cross-sectional areas of the respective outer cylindrical sections without significant reduction in air flow rate. As will be explained further below, a reduction in cross-sectional area of the central section that results in no more than about a 10 percent reduction in flow rate within a given flow rate range is acceptable.

A second unique feature of this conduit is that each outer section 22 may be considerably offset from the center axis of the manhole, which as described above, may be the same as axis 26 of central section 20. Under these conditions, the offsetting of outer sections 22 places them as far outside of the perimeter of the manhole as can practically be permitted. The purpose of this arrangement is to remove as much as possible of the conduit from the manhole area so as to provide a minimum obstruction to a person or equipment entering or leaving through the manhole. The crescent cross-section 29 of central section 20 is made as thin as possible; i.e., inside surface 31 is as close as possible to outside surface 30, so as to provide a minimum obstruction for a person entering or leaving the manhole.

A tab 27 with an opening 28 passing therethrough is shown projecting laterally outwardly from the outside surface 30 of central section 20. This is provided to cooperate with a pin placed on some manholes for the purpose of suspending equipment therefrom. The conduit can hang vertically on such a pin when the axis of the manhole is vertical. If such a pin is not found on the manhole in the areas of use of this conduit, other means may be provided to make the conduit attachable to the manhole. For example, a tab without an opening could be attached to the manhole rim by a clamp. A pin on the conduit could be attachable to a hole or recess in the vicinity of the manhole rim. Other similar attaching means are also operable.

In FIGS. 6–10 there is shown a second exemplary embodiment of the invention. The central section 20, intermediate sections 21, and outer sections 22 are substantially the same as those described above with respect to FIGS. 1–5 except that the cross-section 33 of central section 20 is a segment of a circle (shown cross-hatched in FIG. 10). Outer surface 34 of cross-section 33 is shown to be cylindrical, with a diameter substantially the same as the diameter of the manhole, although this is not critical, as previously explained. Inner surface 35 is a flat plane. As also mentioned previously, inner surface 35 may be two or more intersecting planes, or a curved surface.

Another feature of this second embodiment is the means for hanging the conduit on the manhole. In this embodiment, the means is an arcuate length of a channel member 36 having a short leg 37 welded to outer surface 34 and a longer leg 38 adapted to hang over the rim of a manhole. Open side 39 of channel member 36 faces downwardly to permit the hanging of the conduit on a manhole. The length of member 36 is shown as extending over the entire width of outer surface 34, although it may be appreciated that this is not critical. A shorter length may be employed, or alternatively, a plurality of channel sections may be used in place of one longer section. This style of hanger means is particularly useful when the manhole has an upstanding rim or is provided with one as is the case with some telephone manholes.

Figure 11:
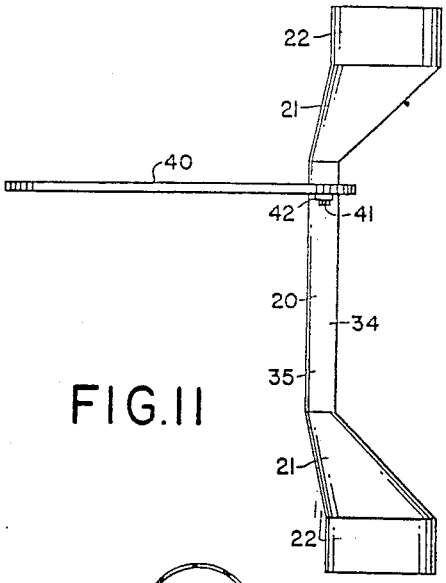
FIG. 11 is a front elevational view of a third embodiment of the conduit of this invention.
Figure 12:
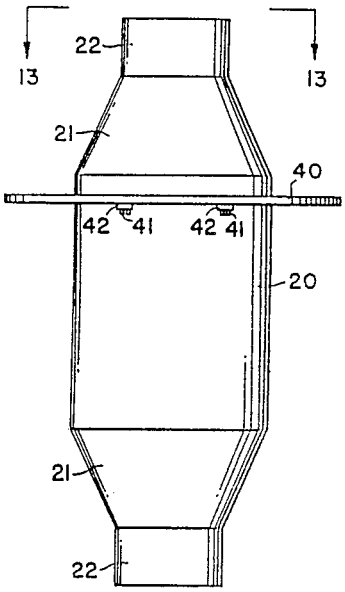
FIG. 12 is a top plan view of the conduit of FIG. 11.
Figure 13:
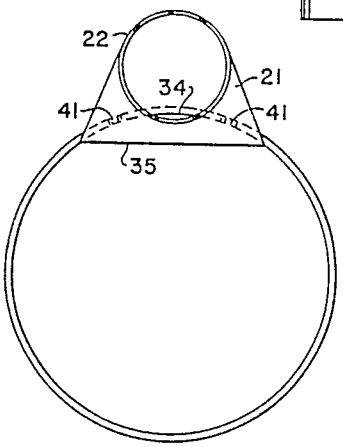
FIG. 13 is an end elevational view looking in the direction of 13—13 of FIG. 12.

In FIGS. 11–13 there is illustrated a third exemplary embodiment where the hanger means is a ring 40 which snugly fits around outer surface 34 and is rigidly attached thereto by welding or by bolt means 41 attached to flange means 42 welded to outer surface 34. As can be appreciated from FIG. 13, and as will be explained in greater detail below with respect to the illustrations in FIGS. 24 and 25, the central section of the conduit protrudes radially into the opening defined by ring 40 (corresponding substantially to the size of the manhole) substantially less than half as much as would the outer section 22 (which corresponds to the diameter of a standard ventilating hose) if the latter were placed in the manhole in a similar location.

In one preferred embodiment, ring 40 is attached to central section 20 by a hinge 43 eliminating bolts 41 and flanges 42 which permits movement of ring 40 from the horizontal operational position shown in FIGS. 11–13 to a folded position 44 for carrying or for storage. This type of hanger means maybe employed on manholes which have a channel rim into which ring 40 fits.

It will be understood, of course, that for different diameter manholes, correspondingly different diameter rings 40 are required, even in the event a single conduit size and configuration is employed.

In some instances, e.g., on ships, the manhole may be oval in shape. In this instance, the conduit of this invention will fit into either end of the oval and employ whatever type of hanger means is available, normally, a tab to hang on a pin around the manhole, as in FIGS. 1–5.

It will be appreciated that the embodiment of FIGS. 6–10 and 11–13 are most suitable for inground manholes particularly since the neck or throat of the manhole often must be extended by additional road covering or dirt fill, etc. Thus, the length of the central section is of any normal length adapted to span the neck or throat of a manhole as would be understood by those having skill in the art.

Figure 14:
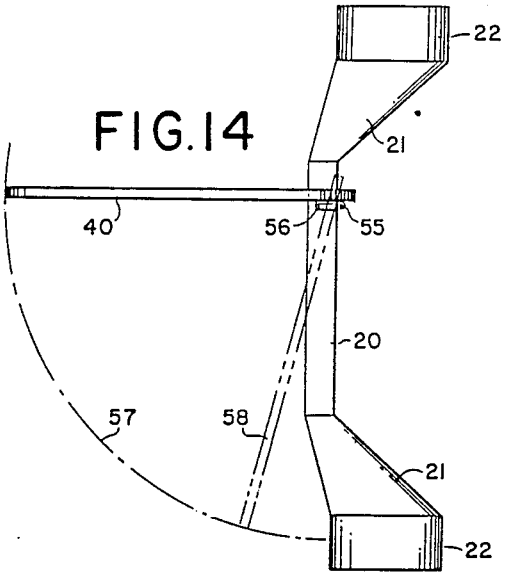
FIG. 14 is a view of an alternative arrangement of the conduit of FIG. 11.
Figure 15:
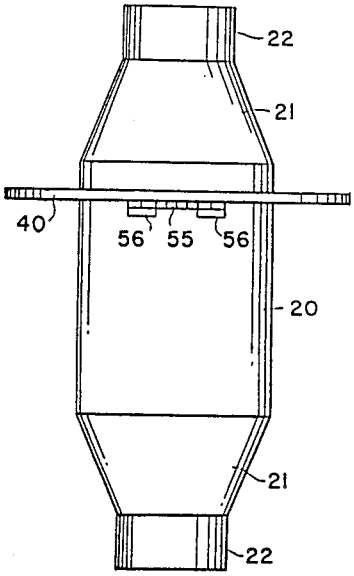
FIG. 15 is a view of an alternative arrangement of the conduit of FIG. 12.
Figure 16:
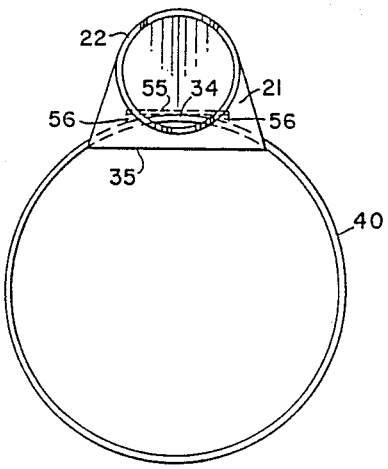
FIG. 16 is a view of an alternative arrangement of the conduit of FIG. 13.

In FIGS. 14–16, there is shown an alternative embodiment of that shown in FIGS. 11–13. Except for the mounting ring 40, the construction is identical to that shown in FIGS. 11–13. In FIGS. 14–16, ring 40 is mounted on a hinge 55 attached to two flanges 56 which are welded to surface 34. Hinge 55 pivots through the quadrant 57 shown in FIG. 14, i.e., ring 40 cannot move above the horizontal as shown in solid lines in FIGS. 14 and 15 but can pivot downwardly to position 58 shown in dotted lines in FIG. 14. This permits the conduit and ring 40 to be folded into a more compact structure for storage.

Figure 1:
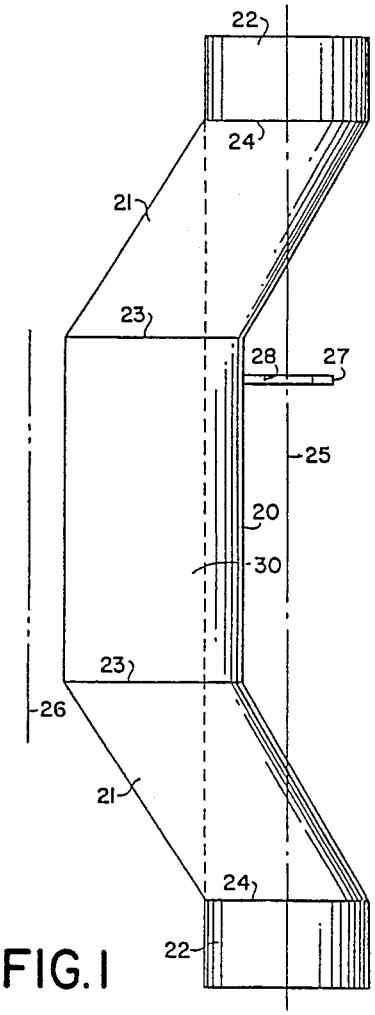
FIG. 1 is a is a front elevational view of one embodiment of the conduit of this invention.
Figure 2:
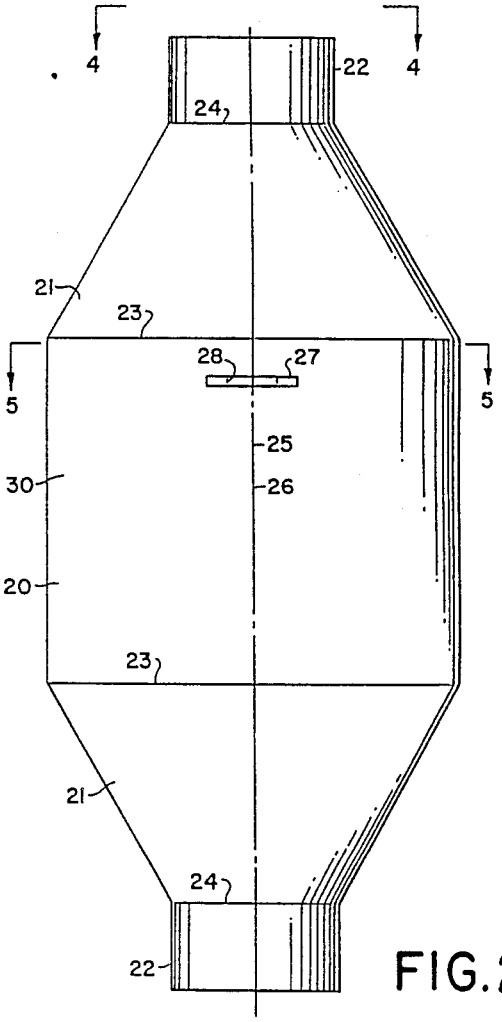
FIG. 2 is a top plan view of the conduit of FIG. 1.
Figure 3:
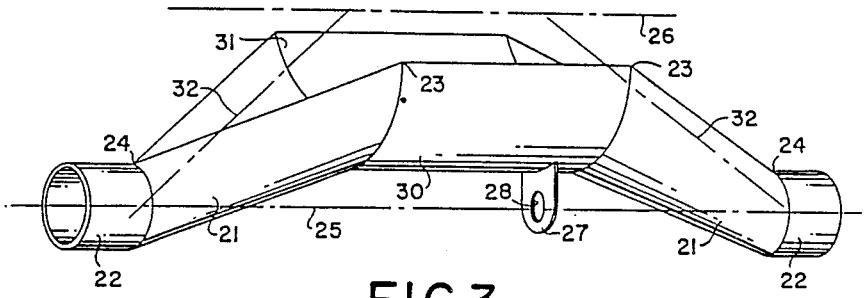
FIG. 3 is a is a perspective view of the conduit of FIG. 1.
Figure 18:
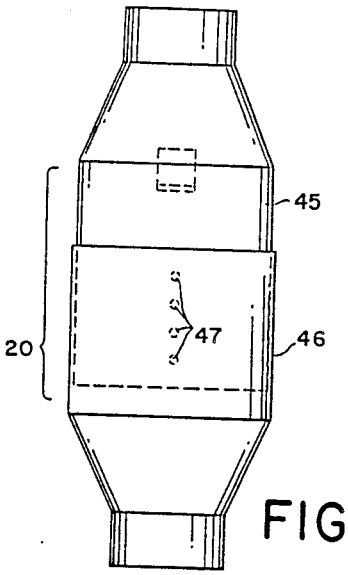
FIG. 18 is a top plan view of the conduit of FIG. 17.
Figure 17:
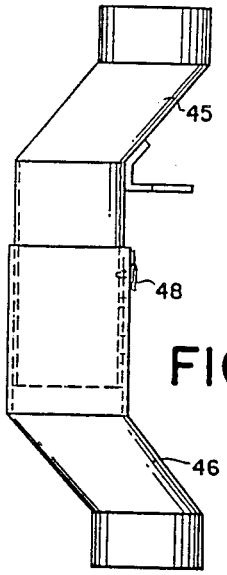
FIG. 17 is a front elevational view of the conduit of this invention having an adjustable central section.
Figure 19:
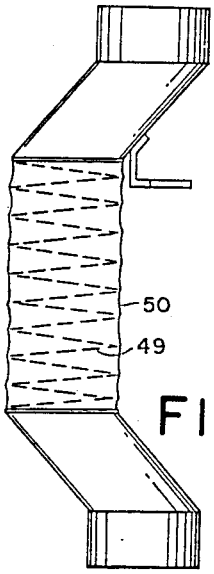
FIG. 19 is a front elevational view of the conduit of this invention having a second type of adjustable central section.
Figure 20:
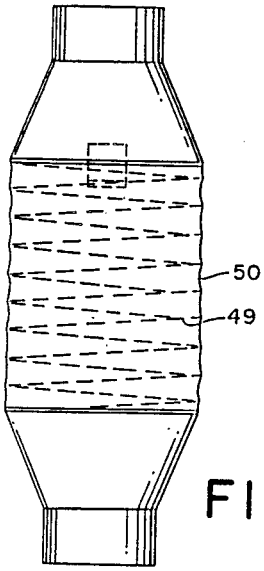
FIG. 20 is a top plan view of the conduit of FIG. 19.
Figure 21:
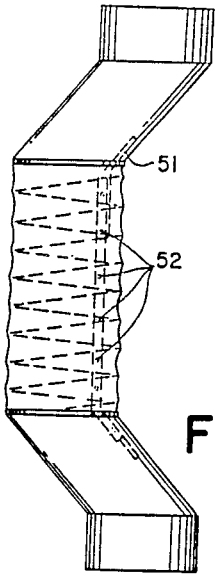
FIG. 21 is a partial front elevational view of the conduit of FIG. 19 showing how the adjustable central section is maintained in its long position.
Figure 22:
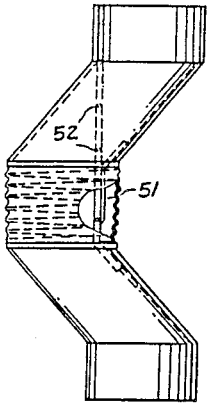
FIG. 22 is a partial front elevational view of the conduit of FIG. 19 showing how the central section is maintained in its short position.
Figure 23:
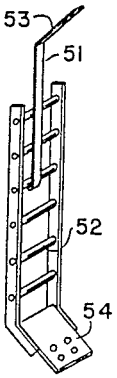
FIG. 23 is an enlarged perspective view of the means of FIGS. 21 and 22 for holding the central section in a selected length.

It may be advantageous to have central section 20 adjustable in its length, i.e., the distance from one juncture 23 to the other juncture 23 in FIG. 3. For example, some manholes may extend through several layers of old roadways while manholes in relatively new roads would have only a short distance to extend through the road bed. As shown in FIGS. 17 and 18, central section 20 may be made telescopic with upper section 45 sliding inside lower section 46. A series of aligned holes 47 in both of sections 45 and 46 are matched with a keeper stud 48 to maintain the length of central section 20 to any selected amount. In another embodiment (see FIGS. 19 and 20) central section is made expandable and contractable by the combination of a helical spring 49 and a tubular cover sheet 50 which is air-impermeable such as textile fabric, rubber, plastic, or the like. The selected length is preferably maintained by the combination of a hook member 51 and a ladder member 52 with several cross bars which can be selectively connected to adjust to a long length as shown in FIG. 21 or a short length as shown in FIG. 22 or any other position of length. The preferred structure is shown in FIG. 20 where hook member 51 is attached to upper section 45 by bolting upper end 53 of hook member 51 thereto, and by bolting plate 54 to lower section 46.

Figure 24:
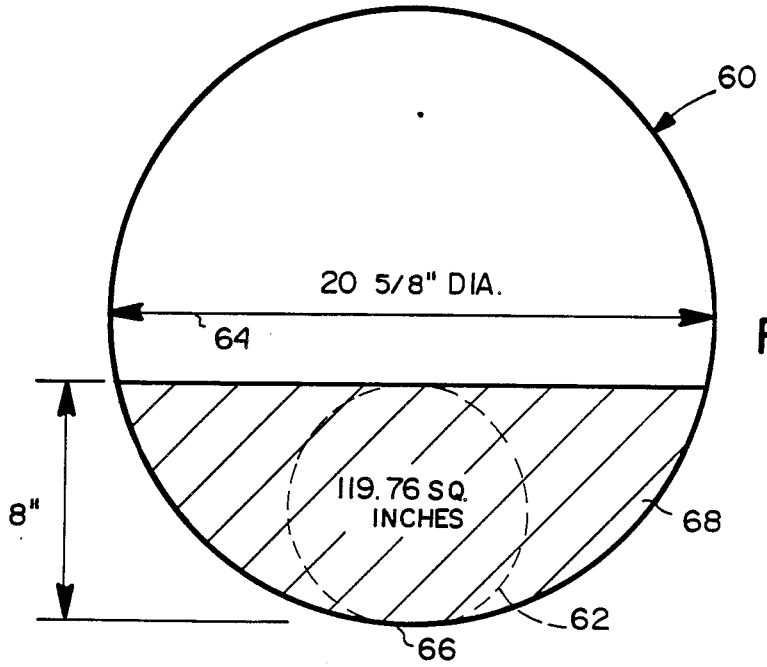
FIG. 24 is a schematic diagram illustrating a manhole and the obstruction area resulting from a standard ventilating conduit.

Turning now to FIG. 24, there is schematically shown a specific example illustrating the cross-sectional area relationships between a manhole 60 having a diameter of 20⅝ inches and a standard 8 inch diameter ventilation conduit 62. The 20⅝ inch diameter manhole represents the smallest available manhole structure which nevertheless enjoys substantial use, i.e., there are smaller manholes but they are not often utilized.

As is readily apparent, the 8 inch conduit extends toward the center line 64 of the manhole a distance of 8 inches from the peripheral edge 66. As a practical matter, this arrangement effectively obstructs about 120 square inches or about 35 percent of the cross-sectional area of the manhole, as designated by the cross-hatched area 68.

Figure 25:
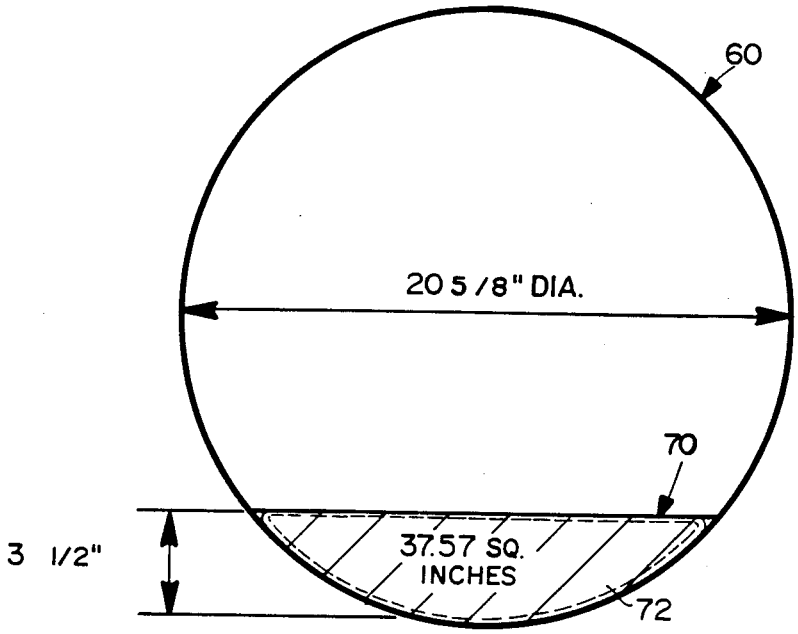
FIG. 25 is a schematic diagram illustrating a manhole and the obstruction area resulting from a ventilating conduit in accordance with a preferred embodiment of this invention.

Referring now to FIG. 25, there is schematically illustrated an example of the minimization of obstruction of the same manhole 60 that is possible with one exemplary embodiment of the invention. While the relationships discussed below are generally apparent also from FIG. 13 (where the attachment ring 40 corresponds substantially to the manhole diameter) they are shown more clearly in FIG. 25. For this specific example, the segment-shaped intermediate section 70 intrudes inwardly from the peripheral edge 66 a distance of 3.5 inches, or less than half that of a standard eight inch diameter hose. The effective obstructed area is calculated to be 37.57 sq. inches, or about 10 percent of the total cross-sectional area of the manhole opening of as designated by cross-hatched area 72. Thus, utilizing a conduit in accordance with this invention and, more specifically a conduit with an intermediate section 70 having a cross-sectional shape corresponding to a segment of a circle (as shown and described in conjunction with FIGS. 8 through 16) a considerable decrease in the obstruction area is achieved.

In the example above, the cross-sectional area of the conduit segment 70 has been reduced about 25 percent relative to the cross-sectional area of the 8 inch diameter outer sections (22 in FIGS. 11–13). Nevertheless, at a flow rate in the previously mentioned range of about 700–800CFM, this 25 percent reduction in cross-sectional area causes a relatively insignificant reduction in flow rate of only about 10 percent, as compared to the flow rate through an 8 inch diameter conduit. This has been determined to be acceptable reduction in the sense that effective ventilation is achieved even with this reduction. It is desirable, however, that the flow rate not be decreased under the same conditions by more than about 10 percent.

It will be appreciated that in the event a conduit of the size illustrated in FIG. 25 is utilized with larger manholes, the percent obstructed are will be even less than shown in FIG. 25.

In a related aspect of the invention, a process is provided for ventilating enclosures accessed by manholes which, in its broader aspects, comprises the following steps:

providing a conduit having at least a pair of end sections 22 and a central section 20, the central section having a different cross-sectional shape than the end sections, and wherein the cross-sectional shape of the central section 20 includes an outer curved surface 30 having a second radius substantially the same as or smaller than the radius of the manhole;

mounting the conduit on the manhole structure 60 so that one end section 22 is located within the enclosure, the central section 20 is located within the opening such that the outer curved surface 30 of the conduit central section lies adjacent the surface of the manhole opening, and the other end section 22 is located outside the enclosure;

connecting the other end section 22 to a source of air P; and supplying air from the source P to the enclosure through the conduit.

It will therefore be seen that the present invention provides manhole ventilating apparatus and a related process which have numerous advantages and which significantly enhance the ability of workers, etc. to enter and exit enclosures accessed by manholes.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A conduit for supplying air through a manhole to the interior of an enclosure wherein said manhole is the entrance/exit for the enclosure, said conduit comprising at least three longitudinal tubular sections, including one central section and two outer sections; at least one of said outer sections having a cylindrical shape and having a first diameter, said central section having a non-cylindrical shape so as to minimize obstruction in the manhole to a person entering or leaving the manhole, said central section being of a size and shape which causes a reduction in air flow rate of no more than about 10 percent relative to the flow rate in a conduit having a diameter substantially the same as said first diameter.

2. The conduit of claim 1 wherein the conduit comprises five longitudinal tubular sections joined end-to-end, including a pair of intermediate sections joining the outer sections to the central section, said central section having the general cross-section of a segment of a circle over the entire length of the central section, and wherein said intermediate sections extend angularly away from said central section, the cross-section of each intermediate section changing throughout its length from the shape of the central section at one end thereof to the shape of the respective outer section at the other end thereof.

3. The conduit of claim 1 wherein said outer sections are aligned on a common axis which is parallel to the axis of said central section.

4. The conduit of claim 1 and including means on the outside of said central section for releasable attachment of said conduit to said manhole.

5. The conduit of claim 1 wherein, when said conduit is mounted to the manhole with the central section of said conduit lying adjacent a peripheral edge of the manhole, the central section extends toward a radial center of the manhole less than half that which would occur if the outer section having the cylindrical shape were located within the manhole and adjacent the same peripheral edge.

6. The conduit of claim 1 wherein the outer section having the cylindrical shape is about eight inches in diameter, and wherein the conduit is adapted to be mounted on a manhole about twenty inches in diameter, and wherein the central section extends toward a radial center of the manhole by about 3.5 inches.

7. The conduit of claim 1 wherein the manhole is circular and said central section has an outer surface which has a radius substantially equal to the radius of said manhole.

8. The conduit of claim 4 wherein said means comprises a ring adapted to fit into a channel rim on a manhole.

9. A conduit for supplying air through a manhole to the interior of an enclosure wherein said manhole is the entrance/exit for the enclosure, said conduit comprising at least three longitudinal tubular sections, including one central section and two outer sections; at least one of said outer sections being cylindrical in shape and having a first diameter, said central section being non-cylindrical in shape so as to minimize obstruction in the manhole to a person entering or leaving the manhole, said central section being of a size and shape which causes an obstruction of no more than about 10 percent of the cross-sectional area of the manhole.

10. A method of ventilating an enclosure with a manhole entrance with minimum obstruction at the manhole comprising the steps of:

(a) providing a conduit having outer open-ended sections which are substantially circular in cross-section, and an intermediate section which is non-circular in cross-section and which obstructs the cross-sectional area of the manhole by not more than about 10 percent; and (b) locating the conduit within the manhole entrance such that the intermediate portion extends from inside the enclosure to outside the enclosure.

11. A method according to claim 10 wherein the intermediate section has a cross-sectional shape of a segment of a circle.

12. A method according to claim 10 wherein the outer open-ended sections of said conduit have a diameter of about eight inches.

13. A method according to claim 12 wherein the intermediate section protrudes toward the center of the manhole from a peripheral edge thereof a distance of about 3.5 inches.

14. A method according to claim 10 wherein the manhole has a diameter of at least about 20 inches, the outer sections of the conduit have a diameter of about 8 inches, and wherein segment shaped intermediate portion protrudes toward the center of the manhole from a peripheral edge thereof by no more than about 3.5 inches.

15. A method according to claim 14 and including the further step of connecting one outer end of said conduit to an air blower, and supplying air under pressure to the enclosure.

16. A method according to claim 15 wherein said air blower is rated at about 500CFM and supplies air to the enclosure in a range of about 700–800CFM.

17. A method of providing air to an enclosure accessed by a manhole structure, the opening of which is defined by at least one curved surface having a first radius, the method comprising the steps of providing a conduit having at least a pair of end sections and a central section, the central section having a different cross-sectional shape than said end sections, and wherein the cross-sectional shape of the central section includes an outer curved surface having a second radius smaller than said first radius;

mounting the conduit on the manhole structure so that one end section is located within the enclosure, the central section is located within the opening such that the outer curved surface of the conduit central section lies adjacent the said at least one curved surface of the manhole opening, and the other end section is located outside the enclosure;

connecting the other end section to a source of air; and supplying air from the source to the enclosure through the conduit.

18. The method of claim 17 wherein the central section has a cross-section in the general shape of a crescent.

19. The method of claim 17 wherein the central section has a cross-section in the general shape of a segment of a circle.

20. The method of claim 18 or 19 wherein the pair of end sections each have a substantially cylindrical cross-section.

21. A method of minimizing obstruction to a person entering an enclosure through a manhole while simultaneously supplying air to the enclosure through the manhole comprising the steps of:

(a) forming a conduit having at least a central section and a pair of end sections, one end section adapted to be located within the enclosure, the other end section adapted to be connected to a source of air outside the enclosure, and the central section adapted to be located within the manhole, wherein at least the other end section has a cylindrical cross-sectional shape, and wherein the central section has a non-cylindrical cross-sectional shape;

(b) mounting the conduit to the manhole so that the central section lies adjacent a peripheral edge of the manhole such that said central section obstructs no more than about 10 percent of the cross-sectional area of the manhole;

(c) connecting the other end section to a source of air; and (d) supplying air to the enclosure through said conduit, the non-cylindrical cross-sectional shape of the central section causing a reduction in flow rate through said central section of not more than about 10 percent as compared to the flow rate in a conduit having a cylindrical cross-section corresponding to said other end section.

22. The method as defined in claim 21 wherein, during the practice of step (b), the central section of the conduit is attached to the manhole.

23. The method as defined in claim 21 wherein in step (c), the source of air comprises an air blower rated at about 500 CFM.

24. The method as defined in claim 21 wherein the manhole is substantially circular, and the central section has at least one outer surface with a radius of curvature substantially the same as, or smaller than that of the manhole.

25. The method as defined in claim 21 wherein, during the practice of step (a), the conduit is formed to further include a pair of intermediate sections connecting the central section to the respective end sections, and wherein each intermediate section has a cross-section which changes continuously from the cross-section of the central section at one end thereof to the cross-section of the end section at the other end thereof.

26. The method as defined in claim 25 wherein the intermediate sections extend away from the manhole when the conduit is mounted therein.

* * * * *